United States Patent [19]

Taylor

[11] Patent Number: 4,646,539

[45] Date of Patent: Mar. 3, 1987

[54] TRANSPORT REFRIGERATION SYSTEM WITH THERMAL STORAGE SINK

[75] Inventor: David H. Taylor, Bloomington, Minn.

[73] Assignee: Thermo King Corporation, Minneapolis, Minn.

[21] Appl. No.: 795,301

[22] Filed: Nov. 6, 1985

[51] Int. Cl.[4] ..... F25B 47/00

[52] U.S. Cl. ..... 62/278; 62/196.4

[58] Field of Search ..... 62/81, 151, 324.6, 278, 62/196.4

[56] References Cited

U.S. PATENT DOCUMENTS

| | | | |
|---|---|---|---|
| 2,698,522 | 1/1955 | La Porte | 62/278 X |
| 3,234,754 | 2/1966 | Quick | 62/278 |
| 3,499,295 | 3/1970 | Brennan | 62/81 |
| 3,677,025 | 7/1972 | Payne | 62/278 X |
| 3,822,562 | 7/1974 | Crosby | 62/278 X |
| 3,939,668 | 2/1976 | Morris | 62/196.4 |
| 4,197,716 | 4/1980 | Nussbaum | 62/196 B |
| 4,246,760 | 1/1981 | Cann et al. | 62/81 |
| 4,302,945 | 12/1981 | Bell | 62/81 |
| 4,343,157 | 8/1982 | Hattori | 62/278 X |

*Primary Examiner*—Lloyd L. King

*Attorney, Agent, or Firm*—E. C. Arenz

[57] ABSTRACT

A transport refrigeration system using a three-way valve 14 for either cooling mode operation and defrost and/or heating mode operation is provided with a thermal storage sink 28 having first and second heat exchangers 26 and 52 and a heat exchange medium 30 therein which serves to sub-cool refrigerant in its passage to the evaporator 36 in a cooling mode, and which serves to evaporate refrigerant in heat exchanger 52 in a defrost mode after the refrigerant has passed through the defrost heat exchanger 42 for defrosting evaporator 36. The stored heat in the medium 30 in the sink serves to hasten the defrost cycle.

4 Claims, 2 Drawing Figures

TRANSPORT REFRIGERATION SYSTEM WITH THERMAL STORAGE SINK

BACKGROUND OF THE INVENTION

Some transport refrigeration units are of a type that have their compressors driven solely by an electric motor, or at times by an electric motor, as distinct from an internal combustion engine with a liquid cooling system. In many instances heat derived from the engine is applied to the refrigerant accumulator of the system and this heat is then available in a defrost cycle to promote and hasten defrosting. It is known that when a refrigeration system is switched from cooling to defrost, there is initially a very low suction and discharge pressure with correspondingly low mass flow of refrigerant, and the increase in the mass flow is at a very slow rate. With an electric motor driven compressor, there is no heat from an engine and in many cases the defrost cycle with hot gas would be inordinately long unless electric heaters were also used to aid in defrosting.

It would therefore be desirable to provide a system in which additional heat is available to the refrigerant to promote and hasten the defrost cycle, and it is to such a system that this invention is directed.

SUMMARY OF THE INVENTION

In accordance with the invention, the refrigeration system includes a three-way valve connected to the compressor discharge, and with this three-way valve in one position the hot gas is passed through the usual refrigerant condenser, and is then directed through a thermal storage sink and then through a thermal expansion device to the evaporator and to the compressor. When the three-way valve is in the other position, the hot gas is passed through a defrost heat exchanger which is in heat exchange relation with the evaporator, and then through a thermal expansion device and through the thermal storage sink before it is returned to the compressor suction side. In a cooling mode, the condensed refrigerant in its passage through the thermal storage sink is subject to being sub-cooled so as to improve refrigeration efficiency. In the defrost mode the hot gas from the other outlet of the three-way valve is condensed in its passage through the defrost heat exchanger and is then expanded through its passage through the thermal static expansion device and evaporates in its passage through the thermal storage sink so that heat is removed from the sink and is available to hasten defrosting.

DRAWING DESCRIPTION

FIG. 1 is a schematic diagram of the system according to the invention in a cooling mode of operation; and FIG. 2 is a schematic diagram of the system in a defrost and/or heating mode of operation.

DESCRIPTION OF THE PREFERRED EMBODIMENT

Figure 1:
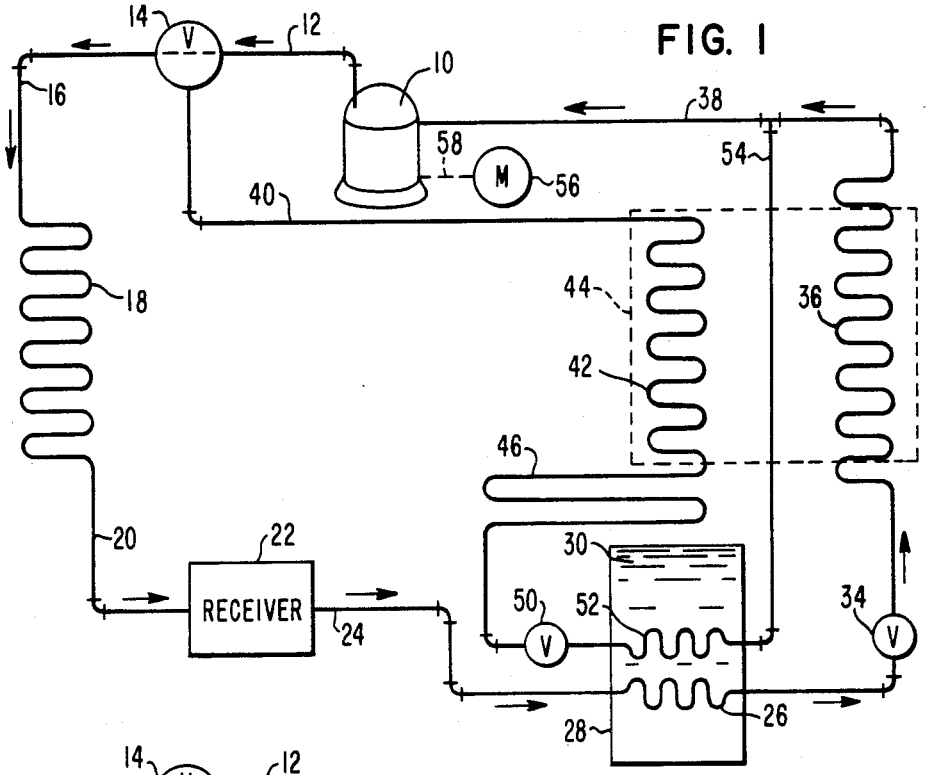
Figure 2:
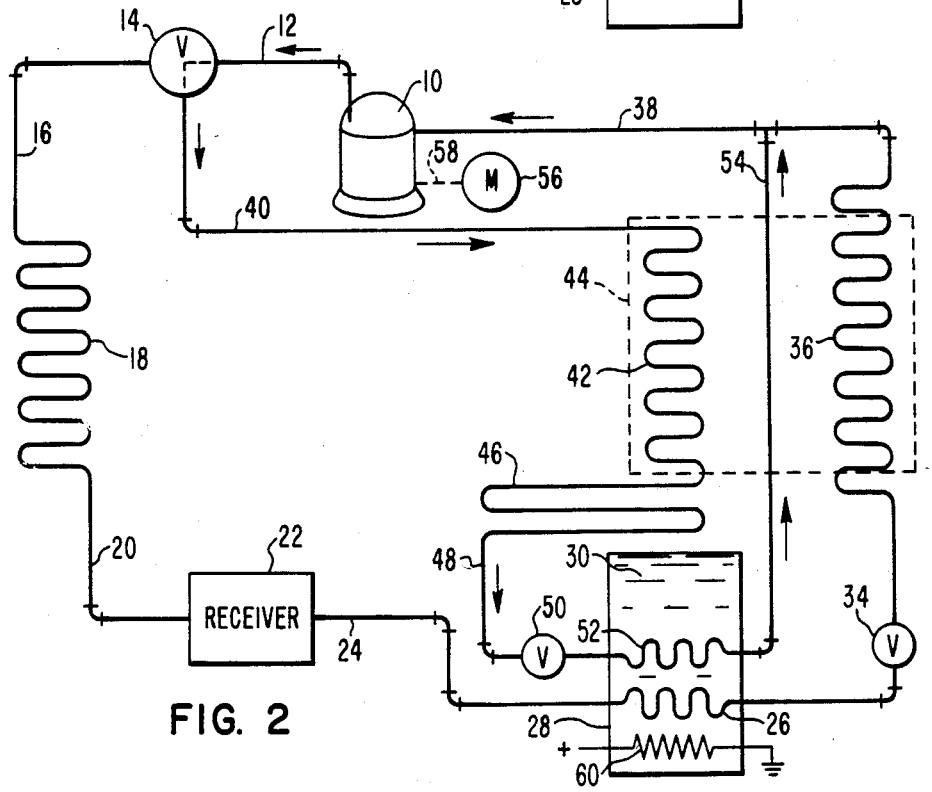

In FIGS. 1 and 2 the refrigerant compressor 10 is connected by dicharge line 12 to three-way valve 14 which directs hot gas to line 16 when the valve is in one position as illustrated in FIG. 1. Line 16 is connected to refrigerant condenser 18 whose outlet is connected to line 20 to the inlet of a refrigerant receiver 22. The outlet of receiver 22 is connected by line 24 to means 26 within the thermal storage sink 28 for exchanging heat with an appropriate medium 30 within the thermal storage sink. Line 32 connects the means 26 to a thermal expansion device 34 at the inlet to the evaporator 36 which has its outlet connected through line 38 to the suction side of the compressor 10.

When the three-way valve 14 is in its second position as indicated in FIG. 2, the hot gas from the compressor is directed through line 40 to a defrost heat exchanger 42. While the heat exchanger is shown in physically separate relation in the drawing, it is to be understood that it would be in heat exchange relation with the evaporator by being in the same tube bundle and this heat exchange relation is indicated by the dash lines 44. The defrost heat exchanger 42 is connected through a drain pan heater loop 46 and line 48 to a second thermostatic expansion device 50. The thermostatic expansion device is connected to second heat exchange means 52 in the thermal storage sink 28, the means 52 also serving to exchange heat with the medium 30 in the sink. Line 54 connects means 52 to the suction line 38 to the compressor.

Numeral 56 idenfities an electric motor coupled through 58 to drive the compressor at all times, or alternatively part of the time, depending upon the particular transport refrigeration unit.

The arrows associated with the various lines in the two figures indicate the direction and path of flow of the refrigerant depending upon whether the unit is in a cooling mode, or a defrost and/or heating mode.

In the cooling mode the hot liquid refrigerant from the receiver 22 is subject to sub-cooling in its passage through the heat exchange 26 in the thermal storage sink 28, this sub-cooling resulting in heat being stored in the medium 30. The sub-cooled liquid then passes through the thermal expansion device and is evaporated in evaporator 36 in usual and conventional fashion.

When the unit is switched to the defrost mode, the hot gas refrigerant passing through the defrost heat exchanger 42 gives up heat to the defrosted evaporator 36 and is subject to being condensed in the defrost heater 42. The refrigerant then expands through the thermal expansion device 50 into the heat exchange means 52 which now functions as an evaporator and will receive heat from the medium 30 to vaporize the refrigerant which is then returned back to the suction side of the compressor.

From the above, it will be appreciated that heat which is stored in the thermal storage sink 28 during the ordinary cooling mode of operation is available to the refrigerant in the defrost mode so that defrosting can be hastened. It is noted that in the cooling mode, the sub-cooling of the refrigerant in its passage through the means 26 also provides a benefit of improving the system efficiency.

The same flow path as in the defrost mode is used if the unit is also to have a heating mode. Depending upon the particular heating requirement, it may be necessary to supplement the hot gas heating by providing means, such as electrical resistance heater 60 in the thermal storage sink, or through some other heat exchange means in the refrigerant flow path, to obtain the required heating capacity.

Depending upon the particular unit and its proposed duty requirements, it is believed that in many instances the usual refrigerant accumulator can be omitted since the thermal storage sink effectively takes its place.

I claim:

1. In a transport refrigeration unit of the type adapted to provide cooling and to be defrosted, a refrigeration system including:

a three-way valve having an inlet, and first and second outlets in accordance with first and second positions, respectively;

a refrigerant compressor having a discharge line connected to supply said three-way valve, and a suction line;

a refrigerant condenser;

a refrigerant evaporator;

a first thermal expansion device at the inlet to said evaporator;

a thermal storage sink having a storage medium;

a defrost heat exchanger in heat exchange relation with said evaporator;

first refrigerant line means connecting the first outlet of said three-way valve to said condenser for operation of the system in a cooling mode with said three-way valve in said first position;

second refrigerant line means extending from said condenser through said thermal storage sink to said first thermal expansion device hot gas refrigerant line means connecting the second outlet of said three-way valve to the inlet of said defrost heat exchanger, the outlet of said defrost heat exchanger being connected to a second thermal expansion device in a third refrigerant line and upstream of said third refrigerant line passing through said thermal storage sink and to the suction side of said compressor;

whereby in a cooling mode with said three-way valve in said first position the refrigerant passing through said thermal storage sink is sub-cooled and transfers heat to said storage medium, and in a defrost mode with said three-way valve in said second position refrigerant passing through said thermal storage sink is evaporated and picks up heat from said storage medium so as to hasten the defrosting process.

2. A system according to claim 1, including a refrigerant receiver in said second line means between said condenser and said thermal storage sink.

3. A system according to claim 1, adapted to also provide heating and including means to add supplemental heat to said hot gas refrigerant line means.

4. A system according to claim 3, wherein said supplemental heat means is adapted to add heat to said thermal storage means.

* * * * *